US006608269B1

(12) United States Patent
Wu

(10) Patent No.: US 6,608,269 B1
(45) Date of Patent: Aug. 19, 2003

(54) WATERPROOF SWITCH

(76) Inventor: Chih-Yuan Wu, 8 Fl., No. 66, Chung-Chen Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/115,713

(22) Filed: Apr. 3, 2002

(51) Int. Cl.[7] ..... H01H 9/00
(52) U.S. Cl. ..... 200/296; 200/307; 431/651
(58) Field of Search ..... 200/293–307; 439/651

(56) References Cited

U.S. PATENT DOCUMENTS 6,066,816 A * 5/2000 Benger ..... 200/296
6,206,733 B1 * 3/2001 Wu ..... 200/307

* cited by examiner

*Primary Examiner*—J. R. Scott
(74) *Attorney, Agent, or Firm*—Thorp Reed & Armstrong LLP

(57) ABSTRACT

A waterproof switch has a head having two feet inserted in a socket. The socket has a plurality of blades formed at a bottom of thereof and extending downwards. A fastener is formed in the socket and the feet are attached to the fastener. A bottom seat is mounted under the socket. The seat has a plurality of chambers defined therethrough to receive the blades. A block is movably received in the seat and aligned with the fastener. The block has a tongue formed at a top thereof and tapered from a bottom to the top.

4 Claims, 4 Drawing Sheets

WATERPROOF SWITCH

BACKGROUND OF THE INVENTION

1. Field of the Invention

The present invention is related to a waterproof switch, and more particularly to the waterproof switch that has a bottom seat for receiving blades of the switch.

2. Description of Related Art

Referring to FIG. 5, a conventional waterproof switch is composed of a head (50) and a socket (60). The head (50) has a button (not numbered) and two feet (52) inserted in the socket (60). The socket (60) has a plurality of blades (62) formed at a bottom thereof for electrically connecting with a circuit.

The feet (52) each have a barb (not numbered) formed thereon and are secured in the socket (60) by the barbs attaching to a fastener, so that it is difficult to disengage the feet (52) from the socket (60). When the head (50) or the socket (60) fails, the whole switch must be rejected because it is impossible to only replace the head (50) or the socket (60). This is not economical and maintenance costs are high.

Moreover, the bare blades (62) are dangerous for operators that install or maintain the switch electrically connected with a power supply.

Therefore, the invention provides the waterproof switch to mitigate and/or obviate the aforementioned problems.

SUMMARY OF THE INVENTION

The main objective of the invention is to provide a waterproof switch that can be easily detached.

Another objective of the invention is to provide a waterproof switch that can prevent an operator from directly touching bare blades.

Other objects, advantages and novel features of the invention will become more apparent from the following detailed description when taken in conjunction with the accompanying drawings.

DETAILED DESCRIPTION OF THE PREFERRED EMBODIMENT

Figure 1:
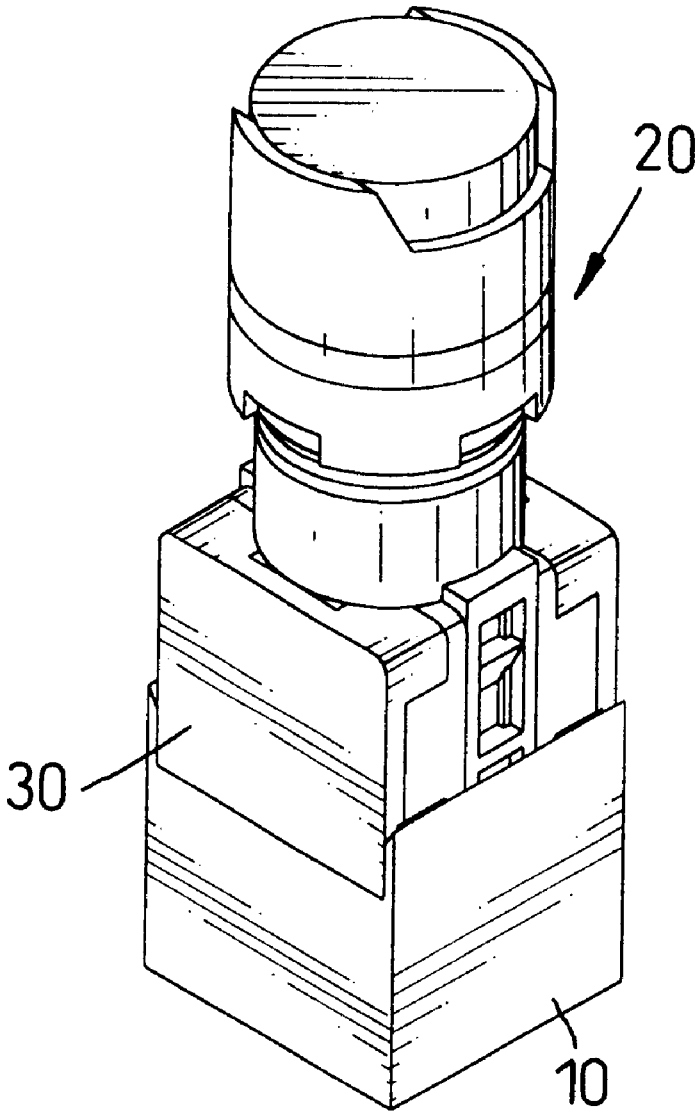
FIG. 1 is a perspective view of a bottom seat in accordance with the invention assembled with a waterproof switch.
Figure 2:
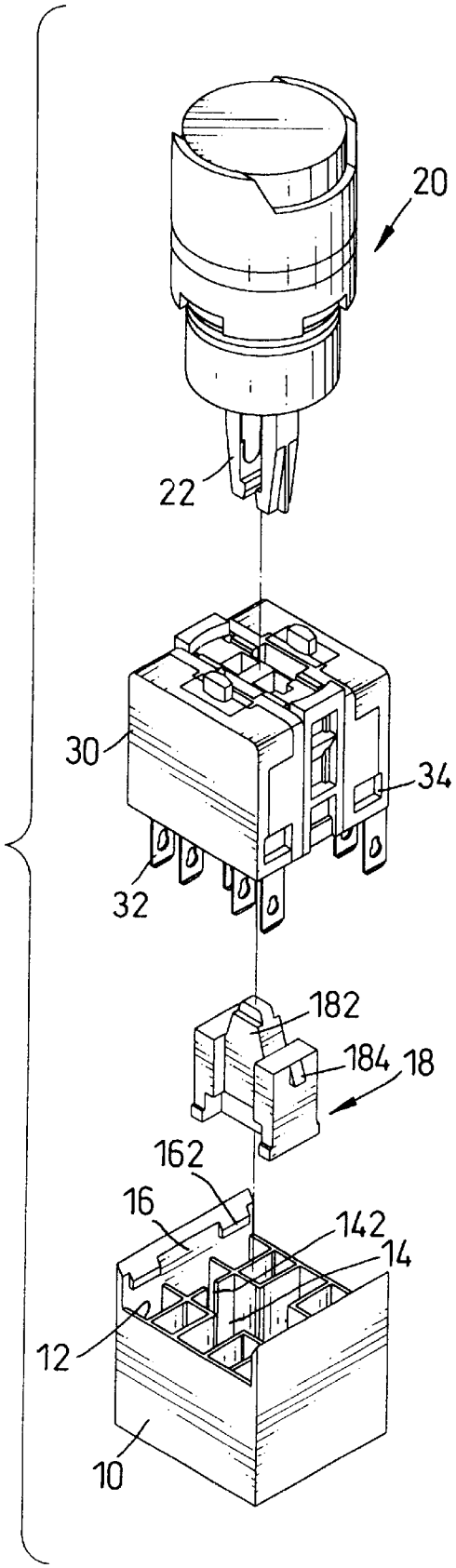
FIG. 2 is an exploded perspective view of the bottom seat and the waterproof switch in FIG. 1.

Referring to FIGS. 1 and 2, a waterproof switch in accordance with the invention is composed of a head (20), a socket (30), and a bottom seat (10).

The head (20) has two feet (22) inserted in the socket (30). The socket (30) has a plurality of blades (32) formed at a bottom thereof and extending downwards. A plurality of apertures (34) is respectively defined at two sides of the socket (30).

Figure 3:
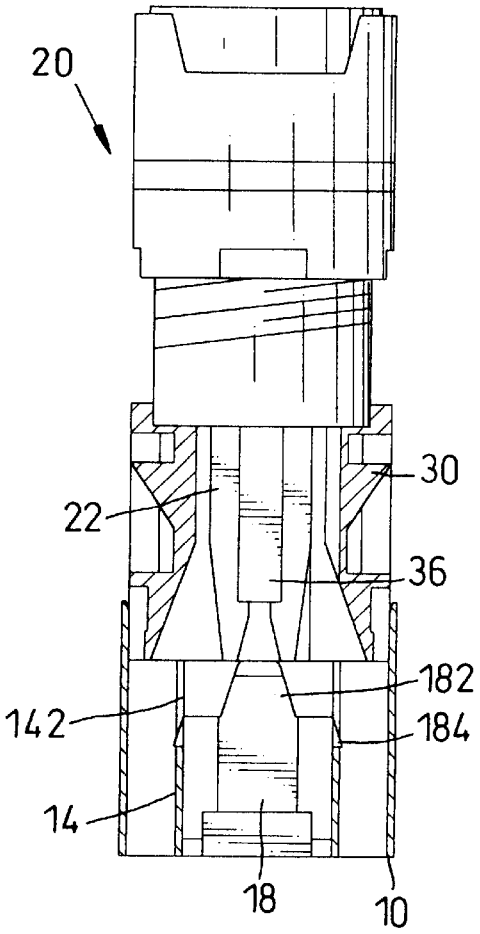
FIG. 3 is a cross sectional view of the bottom seat and the waterproof switch.

The bottom seat (10) is mounted beneath the socket (30) and has a plurality of chambers (12) defined therethrough for receiving the blades (32) of the socket (30). Two upright plates (14) are formed in the bottom seat (10) and separate from each other. Each upright plate (14) has a channel (142) longitudinally defined therethrough. A pushing block (18) is received between the upright plates (14). A tongue (182), which is tapered smaller from a bottom to a top, is formed at the top of the pushing block (18). The tongue (182) is aligned with the feet (22) inserted in the socket (30) and engaged with a fastener (36) of the socket (30), as shown in FIG. 3. Two ears (184) are respectively formed at two sidewalls of the pushing block (18) and received in the channels (142), whereby the pushing block (18) is movable along the upright plates (14). Two wings (16) are respectively formed at two sides of the bottom seat (10). Each wing (16) has at least one barb (162) formed at a top of thereof and engaged in the apertures (34) to assemble the seat (10) and the socket (30) together.

Figure 4:
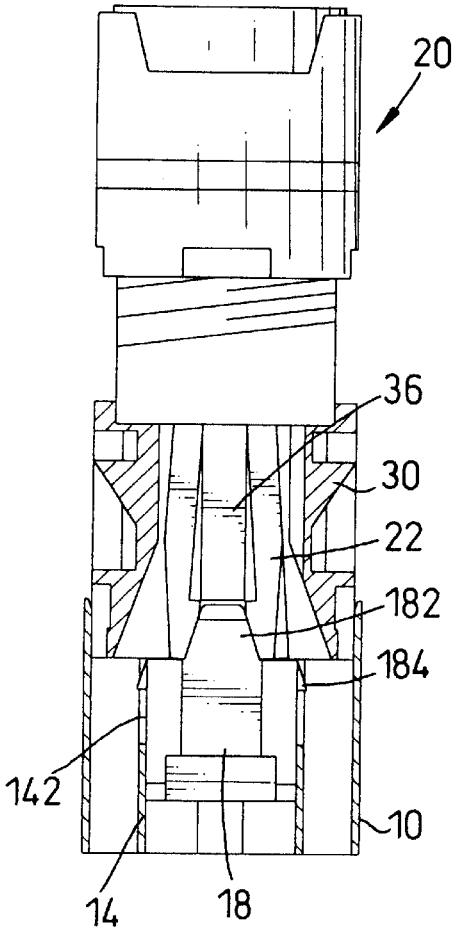
FIG. 4 is another cross sectional view showing that feet of the waterproof switch are disengaged from a socket when a block of the bottom seat is pushed upward.
Figure 5:
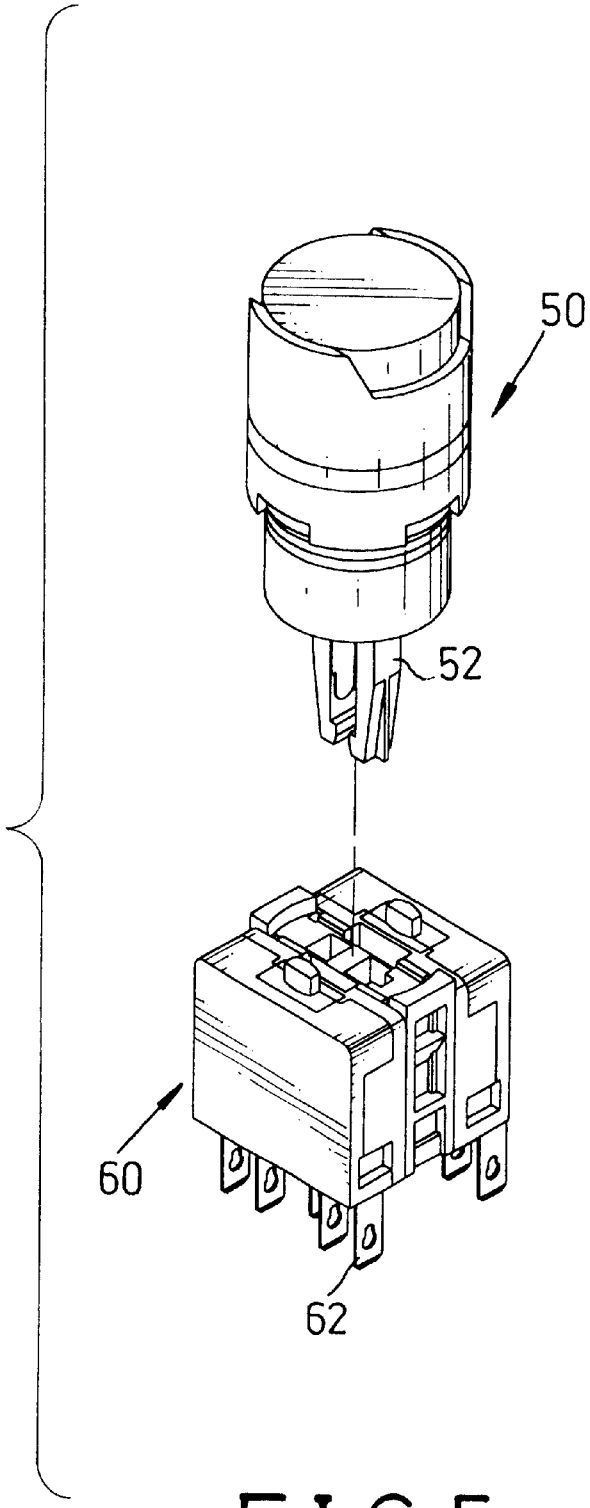
FIG.5 PRIOR ART
FIG. 5 is an exploded perspective view of a conventional waterproof switch.

Referring to FIGS. 3 and 4, when the head (20) needs to be detached from the socket (30), the block (18) is pushed by hands or tools to move upwards along the channels (142). The tapered tongue (182) extends between the feet (22) and the feet (22) are pushed outwards to disengage from the fastener (36). Thus, the head (20) can be removed from the socket (30).

From the above description, it is noted that the invention has the following advantages:

1. The head (20) and the socket (30) can be easily detached by using the block (18) in the bottom seat (10), so that the damaged head (20) or socket (30) can be replaced respectively, which reduces maintenance costs.
2. Because the blades (32) of the socket (30) are received in the chambers (12), it is safe for operators to install or maintain the waterproof switch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof switch comprising:

a head (20) having two feet (22) formed at a bottom thereof;

a socket (30) in which the feet (22) are inserted from a top of the socket (30), the socket (30) having a plurality of blades (32) formed at a bottom of thereof and extending downwards, and a fastener (36) formed therein, the feet (22) attached to the fastener (36); and a bottom seat (10) mounted under the socket (30), the seat (10) having a plurality of chambers (12) defined therethrough to receive the blades (32) in the chambers (12), a block (18) movably received in the seat (10) and aligned with the fastener (36), the block (18) having a tongue (182) formed at a top of the block (18) and tapered from a bottom to the top.

2. The waterproof switch as claimed in claim 1, wherein the bottom seat (10) has two upright plates (14) formed in therein and separate from each other, and the block (18) is received between the upright plates (14).

3. The waterproof switch as claimed in claim 2, wherein the upright plates (14) each have a channel (142) longitudinally defined therethrough, and the block (18) has two ears (184) formed at two sidewalls thereof and received in the channels (142).

4. The waterproof switch as claimed in claim 1, wherein the socket (30) has at least two apertures (34) respectively defined at two sidewalls thereof, and the seat (10) has two wings (16) formed at two sides thereof and extending upwards, each wing (16) having at least one barb (162) engaged in the respective aperture (34).

* * * * *